US011629477B2

(12) United States Patent
Velde et al.

(10) Patent No.: US 11,629,477 B2
(45) Date of Patent: Apr. 18, 2023

(54) SELF-PROPELLED WORK VEHICLE AND CONTROL METHOD FOR BLADE STABILIZATION ACCOUNTING FOR CHASSIS MOVEMENT

(71) Applicant: Deere & Company, Moline, IL (US)

(72) Inventors: Todd F. Velde, Dubuque, IA (US); Daniel M. Kassen, Hazel Green, WI (US)

(73) Assignee: Deere & Company, Moline, IL (US)

( * ) Notice: Subject to any disclaimer, the term of this patent is extended or adjusted under 35 U.S.C. 154(b) by 430 days.

(21) Appl. No.: 16/889,854

(22) Filed: Jun. 2, 2020

(65) Prior Publication Data

US 2021/0372083 A1 Dec. 2, 2021

(51) Int. Cl.

| | |
|---|---|
| ***E02F 3/84*** | (2006.01) |
| ***E02F 9/20*** | (2006.01) |
| ***E02F 9/26*** | (2006.01) |
| ***E02F 3/76*** | (2006.01) |

(52) U.S. Cl.

CPC ..... *E02F 3/844* (2013.01); *E02F 9/2041* (2013.01); *E02F 9/265* (2013.01); *E02F 3/7609* (2013.01)

(58) Field of Classification Search

CPC ..... E02F 9/265; E02F 9/2041; E02F 3/7609; E02F 3/844

USPC ..... 701/50

See application file for complete search history.

(56) References Cited

U.S. PATENT DOCUMENTS

| | | | | |
|---|---|---|---|---|
| 8,141,650 | B2 | 3/2012 | Breiner et al. | |
| 8,634,991 | B2 | 1/2014 | Douglas | |
| 8,919,455 | B2 | 12/2014 | Hendron et al. | |
| 9,234,329 | B2 | 1/2016 | Jaliwala et al. | |
| 9,328,479 | B1 * | 5/2016 | Rausch | E02F 9/265 |
| 9,551,130 | B2 * | 1/2017 | Hendron | E02F 3/7631 |
| 9,624,643 | B2 * | 4/2017 | Hendron | E02F 3/847 |
| 10,066,367 | B1 * | 9/2018 | Wang | E02F 9/265 |
| 10,975,552 | B2 * | 4/2021 | Ono | E02F 3/764 |

(Continued)

FOREIGN PATENT DOCUMENTS

DE 102019121706 A1 2/2020

OTHER PUBLICATIONS

German Search Report issued in application No. DE102021204161.2 dated Jan. 21, 2022 (06 pages).

*Primary Examiner* — Yazan A Soofi

(74) *Attorney, Agent, or Firm* — Gary L. Montle; Lucian Wayne Beavers; Patterson Intellectual Property Law, PC

(57) ABSTRACT

Systems and methods are disclosed herein for controlling a work implement (e.g., front-mounted blade) relative to a work vehicle to produce a desired profile in a ground surface. Chassis-mounted sensor(s) detect an actual pitch velocity and an actual pitch angle of the chassis relative to the ground. Further sensor(s) detect an actual lift position of the blade relative to the chassis. A desired profile to be produced by the blade with respect to the ground surface is determined, for example via an automated grade control system, via manually-initiated trigger(s), and/or via time-based rolling averages of detected values. A position of the implement is automatically controlled as a function of each of the actual pitch velocity, the actual pitch angle of the chassis relative to the ground, and the actual lift position of the work implement relative to the chassis, corresponding to the desired profile with respect to the ground surface.

20 Claims, 4 Drawing Sheets

(56) References Cited

U.S. PATENT DOCUMENTS

| | | | | |
|---|---|---|---|---|
| 10,995,472 | B2 * | 5/2021 | Wiewel | E02F 3/7618 |
| 11,174,619 | B2 * | 11/2021 | Ishibashi | E02F 9/2037 |
| 2009/0112410 | A1 | 4/2009 | Shull | |
| 2013/0080112 | A1 | 3/2013 | Friend | |
| 2014/0343800 | A1 | 11/2014 | Nelson et al. | |
| 2016/0230366 | A1 * | 8/2016 | Hendron | E02F 3/7631 |
| 2019/0023405 | A1 | 1/2019 | Reissig et al. | |
| 2020/0048863 | A1 * | 2/2020 | Faivre | E02F 3/7618 |

* cited by examiner

SELF-PROPELLED WORK VEHICLE AND CONTROL METHOD FOR BLADE STABILIZATION ACCOUNTING FOR CHASSIS MOVEMENT

FIELD OF THE DISCLOSURE

The present disclosure relates generally to self-propelled vehicles such as working machines in the construction and/or agricultural industries which include front-mounted implements for working the terrain. More particularly, the present disclosure relates to systems and methods configured to control the position of a front-mounted work implement for counteracting movement of the vehicle chassis.

BACKGROUND

Work vehicles as discussed herein may for example include dozers, compact track loaders, excavator machines, skid steer loaders, and other self-propelled machines which modify the terrain or equivalent working environment in some way. Work vehicles with ground-engaging blades may be used to shape and smooth ground surfaces. An undercarriage of such work vehicles may be supported from the ground surface by wheeled or tracked ground engaging units, which may encounter high and low spots on the ground as the work vehicles move, further causing the work vehicle to pitch forwards (downwards) or backwards (upwards). This pitching may be transmitted to the ground-engaging blade, causing it to move upwards and downwards relative to the ground, which may move the blade off a designated or desired grade or plane. This effect may be amplified for those work vehicles with a ground engaging blade in front of the work vehicles' tires or tracks, as the work vehicle may pitch forwards or backwards as it encounters the vertical variations created by the ground-engaging blade due to earlier work vehicle pitching. If this effect goes uncorrected by an operator, it may create an undesirable (e.g., "washboard" type) profile on the ground surface or otherwise inhibit the creation of a smooth plane or grade on the ground.

Conventional systems for controlling the position of a ground-engaging blade are known, but typically rely at least partially on sensors disposed on the blade itself to provide inputs for developing the control logic. Such arrangements may expose the sensors to damage, and may further provide a control loop that is inherently reactive to changes in the blade position. It would be desirable to implement an improved control system, relying on sensors in a more secured environment and further being proactive or predictive in nature with respect to undesirable changes in the blade position that may arise during typical operation.

BRIEF SUMMARY

The current disclosure provides an enhancement to conventional systems, at least in part by introducing a novel arrangement of sensors and control logic to augment an operator's lift commands and improve stability of a work vehicle while grading.

In a particular illustrative embodiment as disclosed herein, a method is disclosed for controlling a blade relative to a chassis of a self-propelled work vehicle to produce a desired profile in a ground surface. A first set of one or more chassis-mounted sensors is implemented to detect an actual pitch velocity of the chassis and an actual pitch angle of the chassis relative to the ground, and a second set of one or more sensors is implemented to detect an actual lift position of the blade relative to the chassis. A desired profile to be produced by the blade with respect to the ground surface is determined, and a position of the blade is automatically controlled as a function of each of the actual pitch velocity of the chassis, the actual pitch angle of the chassis relative to the ground, and the actual lift position of the work implement relative to the chassis, corresponding to the desired profile with respect to the ground surface.

In one exemplary aspect of the above-referenced embodiment, the step of determining a desired profile to be produced by the blade with respect to the ground surface may be implemented by setting a first target value corresponding to a pitch angle of the chassis relative to the ground, and setting a second target value corresponding to a lift position of the blade relative to the chassis.

In another exemplary aspect of the above-referenced embodiment, error values may be determined corresponding at least to detected differences between the actual pitch angle, the actual lift position, and the respective first and second target values. The position of the blade may be automatically controlled, further as a function of the determined error values.

In another exemplary aspect of the above-referenced embodiment, indicia may be displayed on a display unit associated with an operator of the work vehicle, the indicia corresponding to one or more of the determined error values.

In another exemplary aspect of the above-referenced embodiment and aspects discussed in relation therewith, the first and second target values may be set to correspond with inputs received from a user via a user interface to an automated grade control system.

Particularly in embodiments wherein an automated grade control system is implemented, the step of determining a desired profile to be produced by the blade with respect to the ground surface may further comprise dynamically setting a third target value corresponding to a pitch velocity of the chassis.

In another exemplary aspect of the above-referenced embodiment and aspects discussed in relation therewith, for example in the absence of an automated grade control system, a first mode of operation may be selectively enabled, wherein at least a lift position is controlled based on control signals responsive to manual input commands. Upon conclusion of the first mode of operation when manual input commands are terminated, the first and second target values may be set to correspond with respective detected actual values for the pitch angle of the chassis relative to the ground and the lift position of the blade relative to the chassis, and a second mode of operation may be initiated for automatically controlling the position of the blade as a function of each of the actual pitch velocity of the chassis, the actual pitch angle of the chassis relative to the ground, and the actual lift position of the work implement relative to the chassis, corresponding to the desired profile with respect to the ground surface.

In another exemplary aspect of the above-referenced embodiment and aspects discussed in relation therewith, again for example in the absence of an automated grade control system, detected actual values for the pitch angle of the chassis relative to the ground and the lift position of the blade relative to the chassis are provided as inputs to a filtering stage, wherein the first and second target values are dynamically set to correspond with respective outputs from the low-pass filtering stage. Low-pass filters may typically be used in the filtering stage, including for example but not expressly limited to moving average filters.

In another exemplary aspect of the above-referenced embodiment, indicia may be displayed on a display unit associated with an operator of the work vehicle, the indicia corresponding to one or more of: the actual pitch velocity of the chassis; the actual pitch angle of the chassis relative to the ground; the actual lift position of the work implement relative to the chassis; the desired profile with respect to the ground surface; and control signals associated with a controlled position of the blade.

In another exemplary aspect of the above-referenced embodiment, the step of determining a desired profile to be produced by the blade with respect to the ground surface comprises setting one or more target values corresponding to respective characteristics at each of one or more locations associated with the blade.

In another exemplary aspect of the above-referenced embodiment, particularly with respect to the immediately preceding aspect, predicted values may be generated for the respective characteristics at each of the one or more locations, as a function of at least each of the actual pitch velocity of the chassis, the actual pitch angle of the chassis relative to the ground, and the actual lift position of the work implement relative to the chassis.

In another exemplary aspect of the above-referenced embodiment, particularly with respect to the immediately preceding aspect, error values may be determined corresponding at least to calculated differences between the predicted values and the target values for the respective characteristics.

In another exemplary aspect of the above-referenced embodiment, particularly with respect to the immediately preceding aspect, the position of the blade may be automatically controlled, further as a function of the determined error values.

In another exemplary aspect of the above-referenced embodiment, particularly with respect to the two immediately preceding aspects, indicia may be displayed on a display unit associated with an operator of the work vehicle, the indicia corresponding to one or more of the determined error values.

In another embodiment as disclosed herein, a self-propelled work vehicle is provided with a chassis supported by a plurality of ground engaging units, and a blade coupled to a front of the chassis in a working direction via a positioning unit configured to at least raise or lower the work implement relative to the chassis. A first set of one or more sensors is fixed with respect to the chassis and configured to generate output signals corresponding to an actual pitch velocity of the chassis and an actual pitch angle of the chassis relative to the ground. A second set of one or more sensors is coupled to the positioning unit and configured to generate output signals corresponding to an actual lift position of the blade relative to the chassis. A controller is functionally linked to the first set of sensors, the second set of sensors, and the positioning unit, and further configured in association therewith for carrying out the steps according to the above-referenced method and exemplary aspects.

In other, further alternative, embodiments the various steps may be carried out in part by implementing a remote computing device and a communications network functionally linked to the self-propelled work vehicle. The remote computing device may include a server system, and/or a mobile computing device such as a phone or tablet carried by an operator of the self-propelled work vehicle.

Numerous objects, features and advantages of the embodiments set forth herein will be readily apparent to those skilled in the art upon reading of the following disclosure when taken in conjunction with the accompanying drawings.

DETAILED DESCRIPTION

Referring now to FIGS. 1-4, various embodiments of a work vehicle and methods of operation may now be described. Generally stated, the following embodiments may utilize various sensor inputs to, for example, augment an operator's lift commands for a work implement such as a ground-engaging blade, and thereby improve the stability of grading operations by counteracting uncontrollable motion in the work vehicle chassis with controlled blade positioning.

Otherwise stated, whereas a work vehicle chassis may undergo regular changes in position during operation, for reasons as further described below, and further wherein these changes in position may not be prevented or satisfactorily corrected for through regulation of ground-engaging units supporting the chassis, the present disclosure provides for a supplemental and unconventional regulation in the context of a position of the ground-engaging blade, which effectively controls the grading operation at the point of impact.

Figure 1:
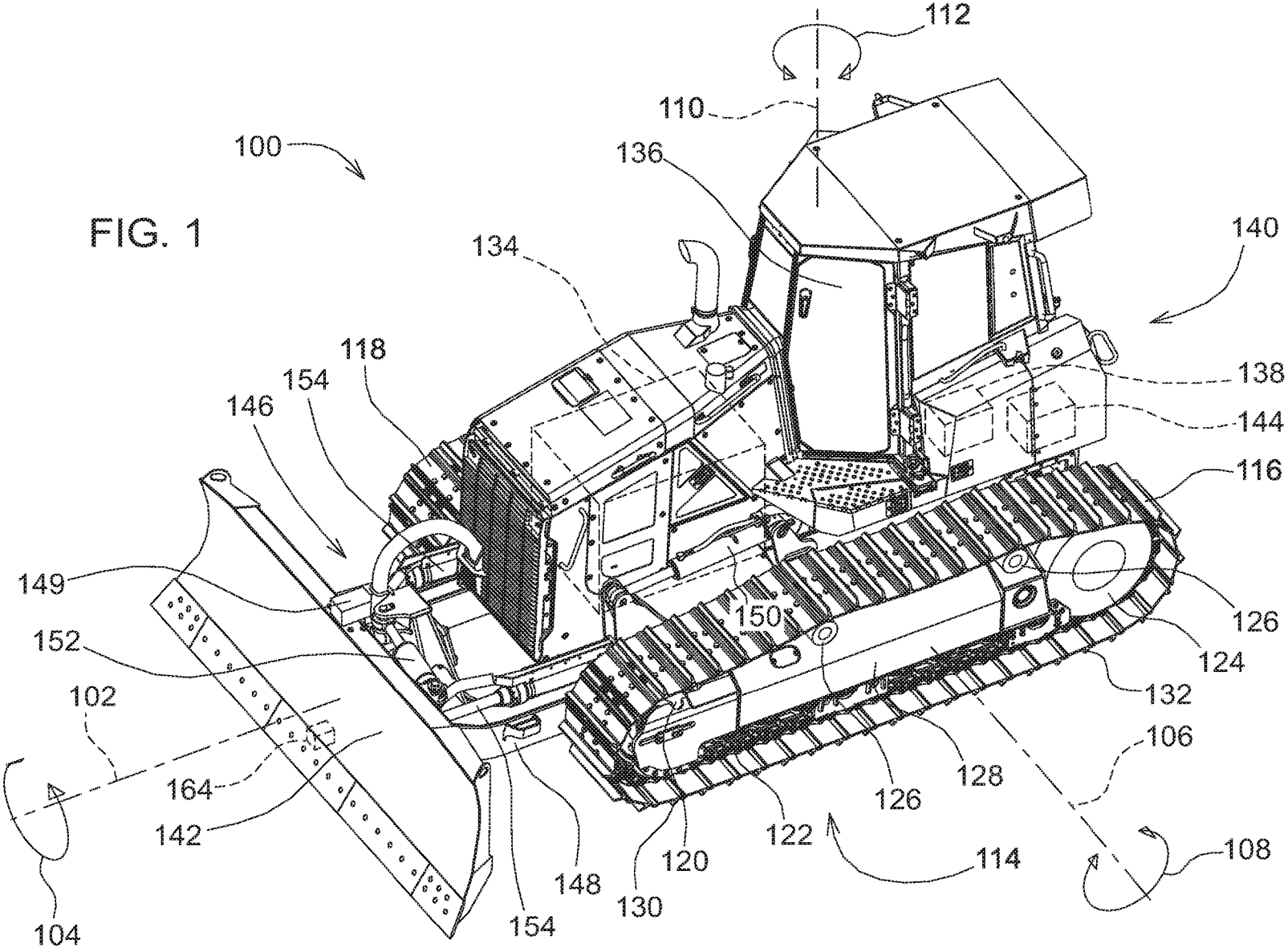
FIG. 1 is a perspective view of a tracked work vehicle incorporating an embodiment of a self-propelled work vehicle and method as disclosed herein.

FIG. 1 is a perspective view of a work vehicle 100. In the illustrated embodiment, the work vehicle 100 is a crawler dozer, but may be any work vehicle with a ground-engaging blade 142 or work implement 142 such as a compact track loader, motor grader, scraper, skid steer, and tractor, to name but a few examples. The work vehicle may be operated to engage the ground and grade, cut, and/or move material to achieve simple or complex features on the ground. While operating, the work vehicle may experience movement in three directions and rotation in three directions. A direction for the work vehicle may also be referred to with regard to a longitudinal direction 102, a latitudinal or lateral direction 106, and a vertical direction 110. Rotation for work vehicle 100 may be referred to as roll 104 or the roll direction, pitch 108 or the pitch direction, and yaw 112 or the yaw direction or heading.

An operator's cab 136 may be located on the chassis 140. The operator's cab and the working implement 142 may both be mounted on the chassis so that the operator's cab faces in the working direction of the working implement. A control station including a user interface (not shown) may be located in the operator's cab. As used herein, directions with regard to work vehicle 100 may be referred to from the perspective of an operator seated within the operator cab: the left of work vehicle is to the left of such an operator, the right of work vehicle is to the right of such an operator, the front or fore of work vehicle is the direction such an operator faces, the rear or aft of work vehicle is behind such an operator, the top of work vehicle is above such an operator, and the bottom of work vehicle is below such an operator.

The term "user interface" as used herein may broadly take the form of a display unit 166 and/or other outputs from the system such as indicator lights, audible alerts, and the like. The user interface may further or alternatively include various controls or user inputs (e.g., a steering wheel, joysticks, levers, buttons) for operating the work vehicle 100, including operation of the engine, hydraulic cylinders, and the like. Such an onboard user interface may be coupled to a vehicle control system via for example a CAN bus arrangement or other equivalent forms of electrical and/or electro-mechanical signal transmission. Another form of user interface (not shown) may take the form of a display that is generated on a remote (i.e., not onboard) computing device, which may display outputs such as status indications and/or otherwise enable user interaction such as the providing of inputs to the system. In the context of a remote user interface, data transmission between for example the vehicle control system and the user interface may take the form of a wireless communications system and associated components as are conventionally known in the art.

The illustrated work vehicle 100 further includes a control system including a controller 138. The controller may be part of the machine control system of the working machine, or it may be a separate control module. Accordingly, the controller may generate control signals for controlling the operation of various actuators throughout the work vehicle 100, which may for example be hydraulic motors, hydraulic piston-cylinder units, electric actuators, or the like. Electronic control signals from the controller may for example be received by electro-hydraulic control valves associated with respective actuators, wherein the electro-hydraulic control valves control the flow of hydraulic fluid to and from the respective hydraulic actuators to control the actuation thereof in response to the control signal from the controller.

The controller 138 may include or be functionally linked to the user interface and optionally be mounted in the operators cab 136 at a control panel.

The controller 138 is configured to receive input signals from some or all of various sensors associated with the work vehicle 100, which in the present disclosure at least includes a first set of one or more sensors 144 affixed to the chassis 140 of the work vehicle 100 and configured to provide a signal indicative of the movement and orientation of the chassis, and a second set of one or more sensors 162 associated with a blade positioning unit 200 and configured to provide at least a signal indicative of a blade lift position. In alternative embodiments, the first sensor 144 may not be affixed directly to the chassis, but may instead be connected to the chassis through intermediate components or structures, such as rubberized mounts. In these alternative embodiments, the sensor 144 is not directly affixed to the chassis but is still connected to the chassis at a fixed relative position so as to experience the same motion as the chassis.

The sensor 144 is configured to provide a signal indicative of the inclination of the chassis 140 relative to the direction of gravity, an angular measurement in the direction of pitch 108. This signal may be referred to as a chassis pitch angle signal. The sensor 144 may also be configured to provide a signal or signals indicative of other positions or velocities of the chassis, including its angular position, velocity, or acceleration in a direction such as the direction of roll 104, pitch 108, yaw 112, or its linear acceleration in a longitudinal 102, latitudinal 106, and/or vertical 110 direction. The sensor 144 may be configured to directly measure inclination, measure angular velocity and integrate to arrive at inclination, or measure inclination and derive to arrive at angular velocity.

The sensor 144 may typically, e.g., be comprised of an inertial measurement unit (IMU) mounted on the chassis and configured to provide at least a chassis pitch angle signal and an angular velocity signal to the controller 138 as inputs for the control method as further disclosed below. Such an IMU may for example be in the form of a three-axis gyroscopic unit configured to detect changes in orientation of the sensor, and thus of the main frame to which it is fixed, relative to an initial orientation. In other embodiments, the one or more sensors may include a plurality of GPS sensing units fixed relative to the chassis and/or the blade positioning unit, which can detect the absolute position and orientation of the work vehicle within an external reference system, and can detect changes in such position and orientation, and/or a camera based system which can observe surrounding structural features via image processing, and can respond to the orientation of the working machine relative to those surrounding structural features.

The controller 138 in an embodiment (not shown) may include or may be associated with a processor, a computer readable medium, a communication unit, data storage such as for example a database network, and the aforementioned user interface or control panel having a display 166. An input/output device, such as a keyboard, joystick or other user interface tool, may be provided so that the human operator may input instructions to the controller. It is understood that the controller described herein may be a single controller having all of the described functionality, or it may include multiple controllers wherein the described functionality is distributed among the multiple controllers.

Various operations, steps or algorithms as described in connection with the controller 138 can be embodied directly in hardware, in a computer program product such as a software module executed by a processor, or in a combination of the two. The computer program product can reside in RAM memory, flash memory, ROM memory, EPROM memory, EEPROM memory, registers, hard disk, a removable disk, or any other form of computer-readable medium known in the art. An exemplary computer-readable medium can be coupled to the processor such that the processor can read information from, and write information to, the memory/storage medium. In the alternative, the medium can be integral to the processor. The processor and the medium can reside in an application specific integrated circuit (ASIC). The ASIC can reside in a user terminal. In the alternative, the processor and the medium can reside as discrete components in a user terminal.

The term "processor" as used herein may refer to at least general-purpose or specific-purpose processing devices and/or logic as may be understood by one of skill in the art, including but not limited to a microprocessor, a microcontroller, a state machine, and the like. A processor can also be implemented as a combination of computing devices, e.g., a combination of a DSP and a microprocessor, a plurality of microprocessors, one or more microprocessors in conjunction with a DSP core, or any other such configuration.

The communication unit may support or provide communications between the controller 138 and external systems or devices, and/or support or provide communication interface with respect to internal components of the work vehicle 100. The communications unit may include wireless communication system components (e.g., via cellular modem, WiFi, Bluetooth or the like) and/or may include one or more wired communications terminals such as universal serial bus ports.

Data storage as discussed herein may, unless otherwise stated, generally encompass hardware such as volatile or non-volatile storage devices, drives, memory, or other storage media, as well as one or more databases residing thereon.

The work vehicle 100 is supported on the ground by an undercarriage 114. The undercarriage 114 includes ground engaging units 116, 118, which in the present example are formed by a left track 116 and a right track 118, and provide tractive force for the work vehicle 100. Each track may be comprised of shoes with grousers that sink into the ground to increase traction, and interconnecting components that allow the tracks to rotate about front idlers 120, track rollers 122, rear sprockets 124 and top idlers 126. Such interconnecting components may include links, pins, bushings, and guides, to name a few components. Front idlers 120, track rollers 122, and rear sprockets 124, on both the left and right sides of the work vehicle 100, provide support for the work vehicle 100 on the ground. Front idlers 120, track rollers 122, rear sprockets 124, and top idlers 126 are all pivotally connected to the remainder of the work vehicle 100 and rotationally coupled to their respective tracks so as to rotate with those tracks. The track frame 128 provides structural support or strength to these components and the remainder of the undercarriage 114. In alternative embodiments, the ground engaging units 116, 118 may comprise, e.g., wheels on the left and right sides of the work vehicle.

Front idlers 120 are positioned at the longitudinal front of the left track 116 and the right track 118, and provide a rotating surface for the tracks to rotate about and a support point to transfer force between the work vehicle 100 and the ground. The left and right tracks rotate about the front idlers as they transition between their vertically lower and vertically upper portions parallel to the ground, so approximately half of the outer diameter of each of the front idlers is engaged with the respective left or right track. This engagement may be through a sprocket and pin arrangement, where pins included in the left and right tracks are engaged by recesses in the front idler so as to transfer force. This engagement also results in the vertical height of the left and right tracks being only slightly larger than the outer diameter of each of the front idlers at the longitudinal front of the tracks. Forward engaging points 130 of the tracks can be approximated as the point on each track vertically below the center of the front idlers, which is the forward point of the tracks which engages the ground. When the work vehicle encounters a ground feature when traveling in a forward direction, the left and right tracks may first encounter it at the forward engaging point. If the ground feature is at a higher elevation than the surrounding ground surface (i.e., an upward ground feature), the work vehicle may begin pitching backward (which may also be referred to as pitching upward) when the forward engaging point reaches the ground feature. If the ground feature is at a lower elevation than the surrounding ground surface (i.e., a downward ground feature), the work vehicle may continue forward without pitching until the center of gravity of the work vehicle is vertically above the edge of the downward ground feature. At that point, the work vehicle may pitch forward (which may also be referred to as pitching downward) until the forward engaging point contacts the ground. In this embodiment, the front idlers are not powered and thus are freely driven by the left and right tracks. In alternative embodiments, the front idlers may be powered, such as by an electric or hydraulic motor, or may have an included braking mechanism configured to resist rotation and thereby slow the left and right tracks.

Track rollers 122 are longitudinally positioned between the front idler 120 and the rear sprocket 124 along the bottom left and bottom right sides of the work vehicle 100. Each of the track rollers may be rotationally coupled to the left track 116 or the right track 118 through engagement between an upper surface of the tracks and a lower surface of the track rollers. This configuration may allow the track rollers to provide support to the work vehicle, and in particular may allow for the transfer of forces in the vertical direction between the work vehicle and the ground. This configuration also resists the upward deflection of the left and right tracks as they traverse an upward ground feature whose longitudinal length is less than the distance between the front idler and the rear sprocket.

Rear sprockets 124 may be positioned at the longitudinal rear of each of the left track 116 and the right track 118 and, similar to the front idlers 120, provide a rotating surface for the tracks to rotate about and a support point to transfer force between the work vehicle 100 and the ground. The left and right tracks rotate about the rear sprockets as they transition between their vertically lower and vertically upper portions parallel to the ground, so approximately half of the outer diameter of each of the rear sprockets is engaged with the respective left or right track. This engagement may be through a sprocket and pin arrangement, where pins included in the left and right tracks are engaged by recesses in the rear sprockets so as to transfer force. This engagement also results in the vertical heights of the tracks being only slightly larger than the outer diameter of each of the rear sprockets at the longitudinal back or rear of the respective track. The rearmost engaging point 132 of the tracks can be approximated as the point on each track vertically below the center of the rear sprockets, which is the rearmost point of the track which engages the ground. When the work vehicle encounters a ground feature when traveling in a reverse or backward direction, the tracks may first encounter it at their respective rearmost engaging point. If the ground feature is at a higher elevation than the surrounding ground surface, the work vehicle may begin pitching forward when the rearmost engaging point reaches the ground feature. If the ground feature is at a lower elevation than the surrounding ground surface, the work vehicle may continue backward without pitching until the center of gravity of the work vehicle is vertically above the edge of the downward ground feature. At that point, the work vehicle may pitch backward until the rearmost engaging point contacts the ground.

In this embodiment, each of the rear sprockets 124 may be powered by a rotationally coupled hydraulic motor so as to drive the left track 116 and the right track 118 and thereby control propulsion and traction for the work vehicle 100. Each of the left and right hydraulic motors may receive pressurized hydraulic fluid from a hydrostatic pump whose direction of flow and displacement controls the direction of rotation and speed of rotation for the left and right hydraulic motors. Each hydrostatic pump may be driven by an engine 134 (or equivalent power source) of the work vehicle, and may be controlled by an operator in the operator cab 136 issuing commands which may be received by the controller 138 and communicated to the left and right hydrostatic pumps. In alternative embodiments, each of the rear sprockets may be driven by a rotationally coupled electric motor or a mechanical system transmitting power from the engine.

Top idlers 126 are longitudinally positioned between the front idlers 120 and the rear sprockets 124 along the left and right sides of the work vehicle 100 above the track rollers 122. Similar to the track rollers, each of the top idlers may be rotationally coupled to the left track 116 or the right track 118 through engagement between a lower surface of the tracks and an upper surface of the top idlers. This configuration may allow the top idlers to support the tracks for the longitudinal span between the front idler and the rear sprocket, and prevent downward deflection of the upper portion of the tracks parallel to the ground between the front idler and the rear sprocket.

The undercarriage 114 is affixed to, and provides support and tractive effort for, the chassis 140 of the work vehicle 100. The chassis is the frame which provides structural support and rigidity to the work vehicle, allowing for the transfer of force between the blade 142 and the left track 116 and right track 118. In this embodiment, the chassis is a weldment comprised of multiple formed and joined steel members, but in alternative embodiments it may be comprised of any number of different materials or configurations.

The blade 142 is a work implement which may engage the ground or material, for example to move material from one location to another and to create features on the ground, including flat areas, grades, hills, roads, or more complexly shaped features. In this embodiment, the blade of the work vehicle 100 may be referred to as a six-way blade, six-way adjustable blade, or power-angle-tilt (PAT) blade. The blade may be hydraulically actuated to move vertically up or down (hereinafter, blade "lift"), roll left or right (hereinafter, blade "tilt"), and yaw left or right (hereinafter, blade "angle"). Alternative embodiments may utilize a blade with fewer hydraulically controlled degrees of freedom, such as a 4-way blade that may not be angled, or actuated in the direction of yaw 112.

The blade 142 is movably connected to the chassis 140 of the work vehicle 100 through a linkage 146 which supports and actuates the blade and is configured to allow the blade to be lifted (i.e., raised or lowered in the vertical direction 110) relative to the chassis. The linkage may include multiple structural members to carry forces between the blade and the remainder of the work vehicle, and may provide attachment points for hydraulic cylinders which may actuate the blade in the lift, tilt, and angle directions. A "blade positioning unit" 200 as referred to herein, and as further described below with respect to FIG. 2, may for example comprise the linkage, along with the hydraulic cylinders, and additional and/or equivalent structures associated with actuation of the blade in the lift, tilt, and angle directions.

The linkage 146 includes a c-frame 148, a structural member with a C-shape positioned rearward of the blade 142, with the C-shape open toward the rear of the work vehicle 100. Each rearward end of the c-frame is pivotally connected to the chassis 140 of the work vehicle 100, such as through a pin-bushing joint, allowing the front of the c-frame to be raised or lowered relative to the work vehicle about the pivotal connections at the rear of the c-frame. The front portion of the c-frame, which is approximately positioned at the lateral center of the work vehicle, connects to the blade through a ball-socket joint. This allows the blade three degrees of freedom in its orientation relative to the c-frame (lift-tilt-angle) while still transferring rearward forces on the blade to the remainder of the work vehicle.

As noted above, a second set of one or more sensors 162 is provided in association with the blade positioning unit 200. The blade 142 may be lifted (i.e., raised or lowered) relative to the work vehicle 100 by the actuation of lift cylinders 150, which may raise and lower the c-frame 148. For each of the lift cylinders, the rod end is pivotally connected to an upward projecting clevis of the c-frame and the head end is pivotally connected to the remainder of the work vehicle just below and forward of the operator cab 136. The configuration of the linkage 146 and the positioning of the pivotal connections for the head end and rod end of the lift cylinders results in the extension of the lift cylinders lowering the blade and the retraction of the lift cylinders raising the blade. In alternative embodiments, the blade may be raised or lowered by a different mechanism, or the lift cylinders may be configured differently, such as a configuration in which extension of the lift cylinders raises the blade and retraction of the lift cylinders lowers the blade. In a particular embodiment, at least one of the second set of sensors 162 is preferably located in association with the lift cylinders, for example to generate an output signal corresponding to an extension of the lift cylinders.

The second set of sensors 162, like the first set of sensors 144, may be configured to measure angular position (inclination or orientation), velocity, or acceleration, or linear acceleration. The sensor 162 (or otherwise stated, another sensor in the second set of sensors 162) may provide a blade inclination signal, which indicates the angle of the blade relative to gravity. In alternative embodiments, the sensor 162 (or otherwise stated, another sensor in the second set of sensors 162) may be configured to instead measure an angle of the linkage 146, such as an angle between the linkage 146 and the chassis 140, in order to determine a position of the blade. In other alternative embodiments, the sensor 162 may be configured to measure a position of the blade by measuring a different angle, such as one between the linkage and the blade, or the linear displacement of a cylinder attached to the linkage or the blade The blade 142 may be tilted relative to the work vehicle 100 by the actuation of a tilt cylinder 152, which may also be referred to as moving the blade in the direction of roll 104. The rod end of the tilt cylinder is pivotally connected to a clevis positioned on the back and left sides of the blade above the ball-socket joint between the blade and the c-frame and the head end is pivotally connected to an upward projecting portion of the linkage 146. The positioning of the pivotal connections for the head end and the rod end of the tilt cylinder result in extension of the tilt cylinder tilting the blade to the left (or counterclockwise when viewed from the operator cab 136) and retraction of the tilt cylinder tilting the blade to the right (or clockwise when viewed from the operator cab. In alternative embodiments, the blade may be tilted by a different mechanism (e.g., an electrical or hydraulic motor) or the tilt cylinder may be configured differently, such as a configuration in which it is mounted vertically and positioned on the left or right side of the blade, or a configuration with two tilt cylinders.

The blade 142 may be angled relative to the work vehicle 100 by the actuation of angle cylinders 154, which may also be referred to as moving the blade in the direction of yaw 112. For each of the angle cylinders, the rod end is pivotally connected to a clevis of the blade while the head end is pivotally connected to a clevis of the c-frame 148. One of the angle cylinders is positioned on the left side of the work vehicle, left of the ball-socket joint between the blade and the c-frame, and the other of the angle cylinders is positioned on the right side of the work vehicle, right of the ball-socket joint between the blade and the c-frame. This positioning results in the extension of the left of the angle cylinders and the retraction of the right of the angle cylinders angling the blade rightward, or yawing the blade clockwise when viewed from above, and the retraction of left of the angle cylinders and the extension of the right of the angle cylinders angling the blade leftward, or yawing the blade counterclockwise when viewed from above. In alternative embodiments, the blade may be angled by a different mechanism or the angle cylinders may be configured differently.

Due to the geometry of the linkage 146 in this embodiment, the blade 142 is not raised or lowered in a perfectly vertical line with respect to the work vehicle 100. Instead, a point on the blade would trace a curve as the blade is raised and lowered. This means that the vertical component of the velocity of the blade is not perfectly proportional to the linear velocity with which the lift cylinders 150 are extending or retracting, and the vertical component of the blade's velocity may vary even when the linear velocity of the lift cylinders is constant. This also means that the lift cylinders have a mechanical advantage which varies depending on the position of the linkage. Given a kinematic model of the blade and the linkage (e.g., formula(s) or table(s) providing a relationship between the position and/or movement of portions of the blade and the linkage) and the state of the blade and the linkage (e.g., sensor(s) sensing one or more positions, angles, or orientations of the blade or linkage, such as the sensor 162), at least with respect to blade lift, the controller 138 may compensate for such non-linearity. Incomplete or simplified kinematic models may be used if there is a need to only focus on particular motion relationships (e.g., only those affecting blade lift) or if only limited compensation accuracy is desired. The controller may utilize this compensation and a desired velocity, for example a command to raise the blade at a particular vertical velocity, to issue a command that may achieve a flow rate into the lift cylinders that results in the blade being raised at the particular vertical velocity regardless of the current position of the linkage. For example, the controller may issue commands which vary the flow rate into the lift cylinders in order to achieve a substantially constant vertical velocity of the blade.

Similarly, due to the positioning of the tilt cylinder 152 and the angle cylinders 154 and the configuration of their connection to the blade 142, the angular velocity of the blade tilt and angle is not perfectly proportional to the linear velocity of the tilt cylinder and the angle cylinders, respectively, and the angular velocity of tilt and angle may vary even when the linear velocity of the tilt cylinder and angle cylinders, respectively, is constant. This also means that the tilt cylinder and the angle cylinders each have a mechanical advantage which varies depending on the position of the blade. Much like with the lift cylinders, given a kinematic model of the blade and the linkage, and the state of the blade and the linkage, at least with respect to the blade tilt and angle, the controller may compensate for such non-linearity. Incomplete or simplified kinematic models may be used if there is a need to only focus on particular motion relationships (e.g., only those affecting blade tilt and angle) or if only limited compensation accuracy is required. The controller may utilize this compensation and a desired angular velocity, for example a command to tilt or angle the blade at a particular angular velocity, to issue commands that may vary the flow rate into the tilt cylinder or angle cylinders to result in the blade being tilted or angled at the particular angular velocity regardless of the current position of the blade or linkage.

In alternative embodiments, the blade may be connected to the remainder of the work vehicle 100 in a manner which tends to make the blade lift velocity (in the vertical direction 110), tilt angular velocity (in the direction of roll 104), or angle angular velocity (in the direction of yaw 112) proportional to the linear velocity of the lift cylinders 150, tilt cylinder 152, or angle cylinders 154, respectively. This may be achieved with particular designs of the linkage 146 and positioning of the pivotal connections of the lift cylinders, tilt cylinder, and angle cylinders. In such alternative embodiments, the controller may not need to compensate for non-linear responses of the blade to the actuation of the lift cylinders, tilt cylinder, and angle cylinders, or the need for compensation may be reduced.

Each of the lift cylinders 150, tilt cylinder 152, and angle cylinders 154 is a double acting hydraulic cylinder. One end of each cylinder may be referred to as a head end, and the end of each cylinder opposite the head end may be referred to as a rod end. Each of the head end and the rod end may be fixedly connected to another component or, as in this embodiment, pivotally connected to another component, such as a through a pin-bushing or pin-bearing coupling, to name but two examples of pivotal connections. As a double acting hydraulic cylinder, each may exert a force in the extending or retracting direction. Directing pressurized hydraulic fluid into a head chamber of the cylinders will tend to exert a force in the extending direction, while directing pressurized hydraulic fluid into a rod chamber of the cylinders will tend to exert a force in the retracting direction. The head chamber and the rod chamber may both be located within a barrel of the hydraulic cylinder, and may both be part of a larger cavity which is separated by a movable piston connected to a rod of the hydraulic cylinder. The volumes of each of the head chamber and the rod chamber change with movement of the piston, while movement of the piston results in extension or retraction of the hydraulic cylinder.

Figure 2:
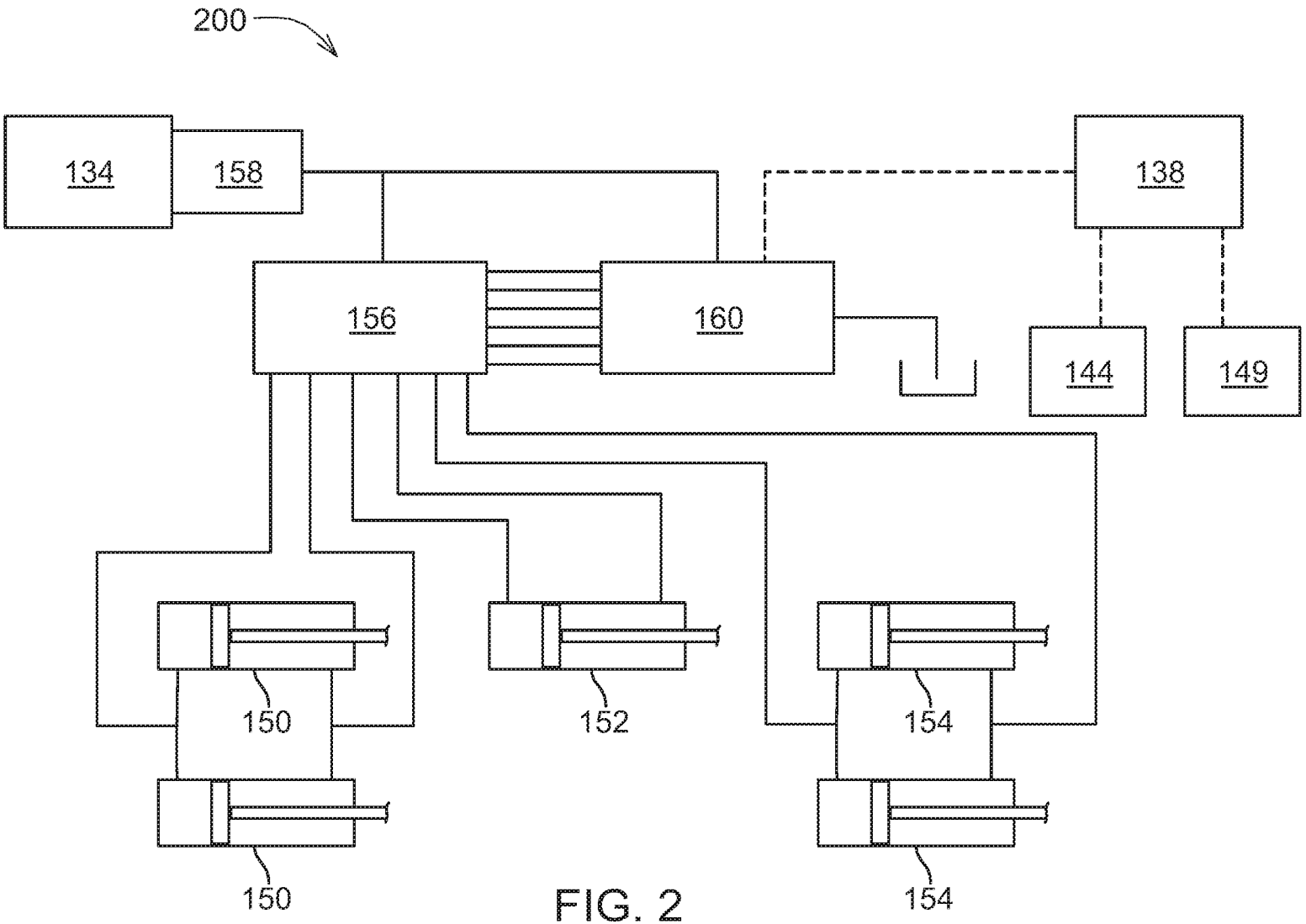
FIG. 2 is a block diagram of an exemplary blade positioning unit according to the embodiment of the tracked work vehicle of FIG. 1.

FIG. 2 is an illustrative schematic of a blade positioning unit 200, for example including hydraulic and electrical components for controlling a position of the blade 142. Each of the lift cylinders 150, the tilt cylinder 152, and the angle cylinders 154 is hydraulically connected to a hydraulic control valve 156, which may be positioned in an interior area of the work vehicle 100. The hydraulic control valve may also be referred to as a valve assembly or manifold. The hydraulic control valve receives pressurized hydraulic fluid from a hydraulic pump 158, which may be rotationally connected to the engine 134, and directs such fluid to the lift cylinders, the tilt cylinder, the angle cylinders, and other hydraulic circuits or functions of the work vehicle. The hydraulic control valve may meter such fluid out, or control the flow rate of hydraulic fluid to each hydraulic circuit to which it is connected. In alternative embodiments, the hydraulic control valve may not meter such fluid out but may instead only selectively provide flow paths to these functions while metering is performed by another component (e.g., a variable displacement hydraulic pump) or not performed at all. The hydraulic control valve may meter such fluid out through a plurality of spools, whose positions control the flow of hydraulic fluid, and other hydraulic logic. The spools may be actuated by solenoids, pilots (e.g., pressurized hydraulic fluid acting on the spool), the pressure upstream or downstream of the spool, or some combination of these and other elements.

In accordance with the embodiment illustrated in FIG. 1, the spools of the hydraulic control valve 156 are shifted by pilots whose pressure is controlled, at least in part, by an electrohydraulic pilot valve 160 in communication with the controller 138. The electrohydraulic pilot valve is positioned within an interior area of the work vehicle and receives pressurized hydraulic fluid from a hydraulic source and selectively directs such fluid to pilot lines hydraulically connected to the hydraulic control valve. In this embodiment the hydraulic control valve and the electrohydraulic pilot valve are separate components, but in alternative embodiments the two valves may be integrated into a single valve assembly or manifold. In this embodiment, the hydraulic source is a hydraulic pump 158. In alternative embodiments, a pressure reducing valve may be used to reduce the pressure of pressurized hydraulic fluid provided by the hydraulic pump to a set pressure, for example 600 pounds per square inch, for usage by the electrohydraulic pilot valve. In the embodiment illustrated in FIG. 2, individual valves within the electrohydraulic pilot valve reduce the pressure from the received hydraulic fluid via solenoid-actuated spools which may drain hydraulic fluid to a hydraulic reservoir. In this embodiment, the controller actuates these solenoids by sending a specific current to each (e.g., 600 mA). In this way, the controller may actuate the blade 142 by issuing electrical commands signals to the electrohydraulic pilot valve, which in turn provides hydraulic signals (pilots) to the hydraulic control valve, which shift spools to direct hydraulic flow from the hydraulic pump to actuate the lift cylinders 150, the tilt cylinder 152, and the angle cylinders 154. In this embodiment, the controller is in direct communication with the electrohydraulic pilot valve via electrical signals sent through a wire harness and is indirectly in communication with the hydraulic control valve via the electrohydraulic pilot valve.

In alternative embodiments, the controller 138 may send a command to actuate the blade 142 in a number of different manners. As one example, the controller may be in communication with a valve controller via a controlled area network (CAN) and may send command signals to the valve controller in the form of CAN messages. The valve controller may receive these messages from the controller and send current to specific solenoids within the electrohydraulic pilot valve 160 based on those messages. As another example, the controller may actuate the blade 142 by actuating an input in the operator cab 136. For example, an operator may use a joystick to issue commands to actuate the blade, and the joystick may generate hydraulic pressure signals, pilots, which are communicated to the hydraulic control valve 156 to cause the actuation of the blade. In such a configuration, the controller may be in communication with electrical devices (e.g., solenoids, motors) which may actuate a joystick in the operator cab. In this way, the controller may actuate the blade by actuating these electrical devices instead of communicating signals to electrohydraulic pilot valve.

Figure 3:
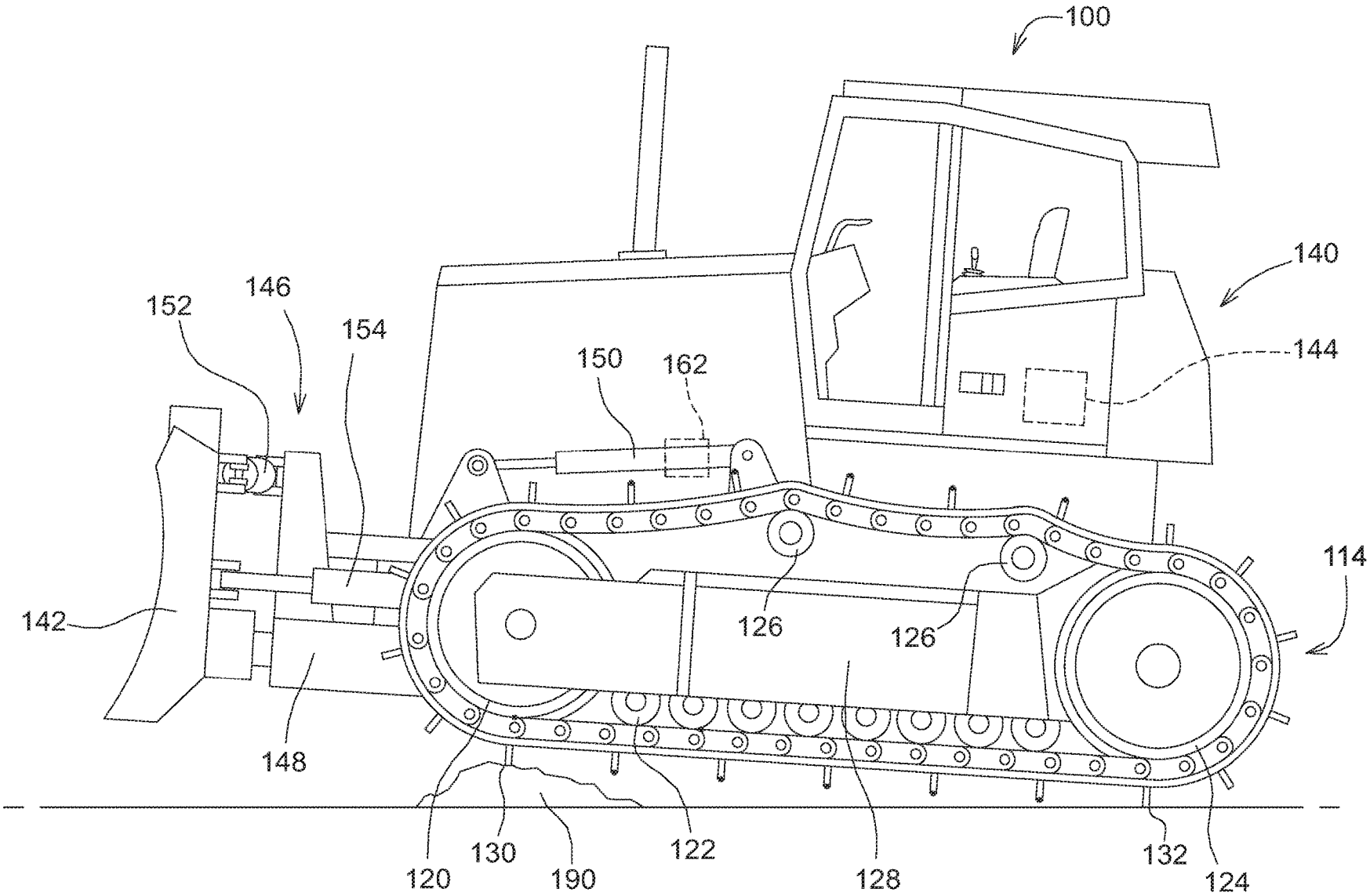
FIG. 3 is a side elevation view of the tracked work vehicle of FIG. 1, engaging an obstacle on the ground surface.

FIG. 3 is a left side view of the work vehicle 100 as the work vehicle drives over a ground feature 190, which in this example is a ground feature at a higher elevation than the surrounding ground surface (e.g., an upward ground feature). As the work vehicle 100 drives over the ground feature, a forward engaging point 130 is the first point on the left track 116 and the right track 118 which substantially engages the ground feature. As the work vehicle engages the ground feature at the forward engaging point, the work vehicle begins to pitch upward or pitch backward as the front of the work vehicle rises on the ground feature relative to the rear of the work vehicle. When pitching upwards or backwards, the work vehicle will tend to pitch about the rearmost engaging point 132. During this pitching, the chassis-mounted sensor 144 may send a signal indicative of the angle of the chassis 140 relative to the direction of gravity (i.e., orientation in the direction of pitch 108) as well as a signal indicative of an angular velocity of the chassis 140 in the direction of pitch 108. These signals will indicate an inclination and velocity in a first direction, angled and pitching upwards, as opposed to the signals indicating an inclination and velocity in a second direction, angled and pitching downwards. In this embodiment, the signals from the sensor 144 to the controller 138 may indicate values within a range for which values in one half of the range indicate pitch angles and angular velocities in the first direction and values in the other half of the range indicate pitch angles and angular velocities in the second direction.

Similarly, the sensor 162 associated with the blade positioning unit 200 may send a blade inclination signal indicative of the pitch angle of the blade 142 relative to the direction of gravity (i.e., orientation in the direction of pitch 108) as well as a blade pitch signal indicative of an angular velocity of the blade 142 in the direction of pitch 108. These signals will indicate an inclination and velocity in a first direction, angled and pitching upwards, as opposed to signals indicating an inclination and velocity in a second direction, angled and pitching downwards. In this embodiment, the blade inclination signal and blade pitch signal from the sensor 162 to the controller 138 may indicate values within a range for which values in one half of the range indicate pitch angles and angular velocities in the first direction and values in the other half of the range indicate pitch angles and angular velocities in the second direction.

As the work vehicle 100 continues to drive over the ground feature 190, the forward engaging point 130 would cease to engage the ground and instead would remain suspended above the ground by a distance determined in part by the height of the ground feature relative to the surrounding ground surface and the position of work vehicle on the ground feature. At this point, although the ground feature is an upward ground feature, it has the effect of a downward ground feature at a lower elevation than the surrounding ground surface. Specifically, the area just past the ground feature is lower than the ground feature. As the center of gravity for the work vehicle passes over the top of the ground feature, the work vehicle will pitch forwards and the rearmost engaging point will leave the ground surface while the forward engaging point will fall until it contacts the ground surface.

During the process of the work vehicle 100 driving over the ground feature 190, the blade 142 will rise and fall relative to the ground surface due to the pitching of the work vehicle. As the work vehicle pitches backward, the blade will rise as the c-frame 148 pitches backward with the work vehicle, and as the work vehicle pitches forward, the blade will fall as the c-frame pitches forward with the work vehicle. If the operator of the work vehicle fails to correct for the ground feature by commanding the blade to rise or fall in a manner that counteracts the effect of the ground feature on the height of the blade, the work vehicle will create vertical variations on the ground surface instead of a smooth surface, such as a hill and a valley. As the work vehicle drives over this newly created hill and valley on the ground surface, the blade will once again be raised and lowered as the work vehicle pitches backward and forward, creating further vertical variations. This series of hills and valleys may be referred to as a "washboard" pattern. In addition to creating this pattern, the pitching of the work vehicle will also interrupt efforts to maintain a uniform grade. An operator of the work vehicle may target a particular grade (e.g., 2%) and if traveling up or down the grade, the pitching of the work vehicle will create segments where the actual grade is steeper or shallower than the target grade.

Figure 4:
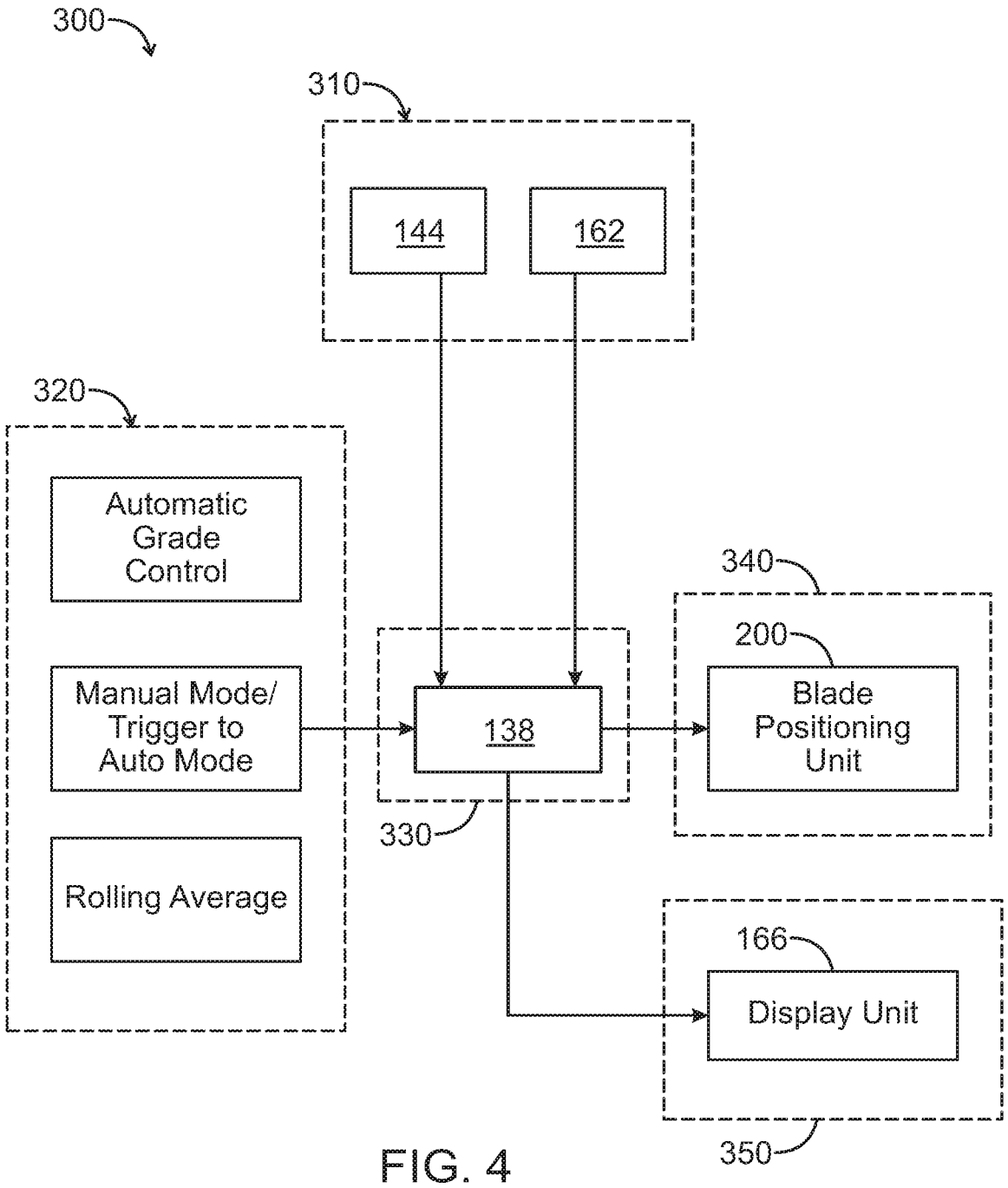
FIG. 4 is a block diagram representing an exemplary control system and method of operation of a self-propelled work vehicle as disclosed herein.

An exemplary embodiment of a method 300 may now be described for controlling a blade 142 relative to a chassis of a self-propelled work vehicle 100 to produce a desired profile in a ground surface, by further illustrative reference to FIG. 4.

A first exemplary step 310 of the method includes detecting, via a first set of one or more chassis-mounted sensors 144, an actual pitch velocity of the chassis and an actual pitch angle of the chassis relative to the ground, and further detecting, via a second set of one or more sensors 162, an actual lift position of the blade relative to the chassis.

In a second exemplary step 320 of the method, information is provided to a controller 138 which corresponds to a desired profile to be produced by the blade with respect to the ground surface. The controller determines the desired profile to be produced in a third exemplary step 330, wherein output signals may be provided in a fourth exemplary step 340 to automatically control a position of the blade. The output signals in a preferred embodiment are calculated lift commands for a blade positioning system 200, the lift commands consisting of three specific terms. The first term is a function of a pitch velocity error, relative to a target pitch velocity, the second term is a function of a pitch angle error, relative to a target pitch angle, and the third term is a function of a lift position error, relative to a target lift position, each of the command terms corresponding to the desired profile with respect to the ground surface.

In an embodiment, the information corresponding to a desired profile to be produced by the blade with respect to the ground surface may include a first target value set as corresponding to a desired pitch angle of the chassis relative to the ground, and a second target value set as corresponding to a lift position of the blade relative to the chassis. A third target value may in certain embodiments be further set as corresponding to a desired pitch angular velocity of the chassis, particularly where an automated grade control system is being implemented as further described below, but in many cases the third target value may be implicitly characterized as zero. With the aforementioned target values having been set, the controller may be configured to determine error values corresponding at least to detected differences between the actual pitch angle, the actual lift position, and the respective first and second target values, and further to automatically control the position of the blade, further as a function of the determined error values.

In accordance with this embodiment, a fifth step 350 of the method may include displaying indicia on a display unit 166 associated with the work vehicle, for example in the operator cab 136, on a mobile computing device carried by an operator or other user, or the like. The indicia may for example correspond to one or more of the determined error values (e.g., in absolute or relative form). Even in embodiments where the error values are not expressly determined and accordingly displayable, additional or alternative indicia may be displayable, including for example an actual (i.e., detected) and/or target pitch velocity of the chassis, an actual (i.e., detected) and/or target pitch angle of the chassis relative to the ground, an actual (i.e., detected) and/or target lift position of the blade relative to the chassis, one or more characteristics of a desired profile with respect to the ground surface, control signals associated with a controlled position of the blade, and the like.

In an embodiment, the information corresponding to a desired profile to be produced by the blade with respect to the ground surface may be provided by or otherwise as part of an automated grade control system. The system may include a user interface configured to enable operator entry, selection, or otherwise specification of a desired grade profile (slope of surface), wherein target values corresponding to the blade control parameters may be automatically derived. The operator selection may take the form of a predetermined group setting wherein target values may at least initially be retrieved from memory, or the operator may select one or more baseline values wherein the controller obtains or ascertains the control parameters to correspond therewith. The controller may be connected in certain embodiments to receive input signals corresponding to one or more characteristics of a non-graded ground surface, wherein one or more of the target values may be derived at least in part based thereon.

In an alternative embodiment, the information corresponding to a desired profile to be produced by the blade with respect to the ground surface may be provided manually by a system user via for example a user interface configured therefor. The manual user input in such an embodiment may typically include the first target value corresponding to a desired pitch angle of the chassis relative to the ground, and the second target value corresponding to a lift position of the blade relative to the chassis. The third target value corresponding to a desired pitch angular velocity of the chassis may also optionally be manually settable, but otherwise may be implicitly characterized as zero.

In another alternative embodiment, the control system may be selectively operable in a first operating mode, wherein at least a lift position of the blade is controlled based on control signals responsive to manual input commands, for example via joysticks or similar components in the operator cab. Upon conclusion of the first mode of operation, which may take place automatically when manual input commands are terminated or otherwise upon receiving a dedicated mode switching input signal, the first and second target values may be set to correspond with respective detected actual values for the pitch angle of the chassis relative to the ground and the lift position of the blade relative to the chassis. At this point, a second mode of operation may be initiated, for automatically controlling the position of the blade as a function of each of the actual pitch velocity of the chassis, the actual pitch angle of the chassis relative to the ground, and the actual lift position of the work implement relative to the chassis, corresponding to the desired profile with respect to the ground surface. Initiation of the second mode of operation may automatically be triggered upon conclusion of the first mode of operation, or may require a separate input signal from the operator or other source.

In another alternative embodiment, detected actual values for the pitch angle of the chassis relative to the ground and the lift position of the blade relative to the chassis are provided as inputs to a filtering stage, wherein the first and second target values are dynamically set to correspond with respective outputs from the low-pass filtering stage. Low-pass filters may typically be used in the filtering stage, including for example but in no way expressly limited to moving average filters for smoothing fluctuations in input time-series data.

The control system and method 300 as disclosed herein may alternatively be configured to determining a desired profile to be produced by the blade with respect to the ground surface by setting one or more target values corresponding to respective characteristics at each of one or more locations associated with the blade. While physical sensors in accordance with the present disclosure are not located on the blade itself, or at least are not relied upon for the input of actual measurements for control parameters, such an embodiment may implement one or more virtual sensors 164 projected upon respective locations associated with the blade.

For example, the controller may be configured in steps 320 and 330, based upon input signals received in step 310 from the first set of sensors 144 and the second set of sensors 162, to generate predicted values for the respective characteristics at each of the one or more locations, as a function of at least each of the actual pitch velocity of the chassis, the actual pitch angle of the chassis relative to the ground, and the actual lift position of the work implement relative to the chassis, and further to determine error values corresponding at least to calculated differences between the predicted values and the target values for the respective characteristics. With the error values having been determined, representing differences between a target grade profile (i.e., targeted positioning of the blade) and an actual grade profile (i.e., measured or projected positioning of the blade), the controller in step 340 automatically controlling the position of the blade via control signals to the blade positioning unit 200, further as a function of the determined error values.

As used herein, the phrase "one or more of," when used with a list of items, means that different combinations of one or more of the items may be used and only one of each item in the list may be needed. For example, "one or more of" item A, item B, and item C may include, for example, without limitation, item A or item A and item B. This example also may include item A, item B, and item C, or item Band item C.

Thus, it is seen that the apparatus and methods of the present disclosure readily achieve the ends and advantages mentioned as well as those inherent therein. While certain preferred embodiments of the disclosure have been illustrated and described for present purposes, numerous changes in the arrangement and construction of parts and steps may be made by those skilled in the art, which changes are encompassed within the scope and spirit of the present disclosure as defined by the appended claims. Each disclosed feature or embodiment may be combined with any of the other disclosed features or embodiments.

What is claimed is:

1. A method of controlling a blade relative to a chassis of a self- propelled work vehicle to produce a desired profile in a ground surface, wherein the blade is coupled to the chassis and further at least lifted relative to the chassis via at least a blade positioning unit, the method comprising:

detecting, via a first set of one or more chassis-mounted sensors, an actual pitch velocity of the chassis and an actual pitch angle of the chassis relative to the ground;

detecting, via a second set of one or more sensors associated with the blade positioning unit, an actual lift position of the blade relative to the chassis;

determining a desired profile to be produced by the blade with respect to the ground surface; and automatically controlling a position of the blade as a function of each of the actual pitch velocity of the chassis, the actual pitch angle of the chassis relative to the ground, and the actual lift position of the work implement relative to the chassis, corresponding to the desired profile with respect to the ground surface.

2. The method of claim 1, wherein the step of determining a desired profile to be produced by the blade with respect to the ground surface comprises:

setting a first target value corresponding to a pitch angle of the chassis relative to the ground, and setting a second target value corresponding to a lift position of the blade relative to the chassis.

3. The method of claim 2, further comprising:

determining error values corresponding at least to detected differences between the actual pitch angle, the actual lift position, and the respective first and second target values, and automatically controlling the position of the blade, further as a function of the determined error values.

4. The method of claim 3, further comprising displaying indicia on a display unit associated with an operator of the work vehicle, the indicia corresponding to one or more of the determined error values.

5. The method of claim 2, wherein the first and second target values are set to correspond with inputs received from a user via a user interface to an automated grade control system.

6. The method of claim 5, wherein the step of determining a desired profile to be produced by the blade with respect to the ground surface further comprises:

dynamically setting a third target value corresponding to a pitch velocity of the chassis.

7. The method of claim 2, further comprising:

selectively enabling a first mode of operation, wherein at least a lift position is controlled based on control signals responsive to manual input commands, upon conclusion of the first mode of operation when manual input commands are terminated, setting the first and second target values to correspond with respective detected actual values for the pitch angle of the chassis relative to the ground and the lift position of the blade relative to the chassis, and initiating a second mode of operation, for automatically controlling the position of the blade as a function of each of the actual pitch velocity of the chassis, the actual pitch angle of the chassis relative to the ground, and the actual lift position of the work implement relative to the chassis, corresponding to the desired profile with respect to the ground surface.

8. The method of claim 2, wherein detected actual values for the pitch angle of the chassis relative to the ground and the lift position of the blade relative to the chassis are provided as inputs to a filtering stage, wherein the first and second target values are dynamically set to correspond with respective outputs from the filtering stage.

9. The method of claim 1, further comprising displaying indicia on a display unit associated with an operator of the work vehicle, the indicia corresponding to one or more of:

the actual pitch velocity of the chassis;

the actual pitch angle of the chassis relative to the ground;

the actual lift position of the work implement relative to the chassis;

the desired profile with respect to the ground surface; and control signals associated with a controlled position of the blade.

10. The method of claim 1, further comprising projecting one or more virtual sensors upon respective locations associated with the blade, wherein the step of determining a desired profile to be produced by the blade with respect to the ground surface comprises setting one or more target values corresponding to respective characteristics at each of the one or more locations, and the method further comprises:

generating predicted values for the respective characteristics at each of the one or more locations, as a function of at least each of the actual pitch velocity of the chassis, the actual pitch angle of the chassis relative to the ground, and the actual lift position of the work implement relative to the chassis.

11. The method of claim 10, further comprising:

determining error values corresponding at least to calculated differences between the predicted values and the target values for the respective characteristics, and automatically controlling the position of the blade, further as a function of the determined error values.

12. The method of claim 11, further comprising displaying indicia on a display unit associated with an operator of the work vehicle, the indicia corresponding to one or more of the determined error values.

13. A self-propelled work vehicle comprising:

a chassis supported by a plurality of ground engaging units;

a blade coupled to a front of the chassis in a working direction via a positioning unit configured to at least raise or lower the blade relative to the chassis;

a first set of one or more sensors fixed with respect to the chassis and configured to generate output signals corresponding to an actual pitch velocity of the chassis and an actual pitch angle of the chassis relative to the ground;

a second set of one or more sensors coupled to the positioning unit and configured to generate output signals corresponding to an actual lift position of the blade relative to the chassis; and a controller functionally linked to the first set of sensors, the second set of sensors, and the positioning unit, and configured to control the positioning unit to at least raise or lower the blade relative to chassis, as a function of each of the actual pitch velocity of the chassis, the actual pitch angle of the chassis relative to the ground, and the actual lift position of the blade relative to the chassis, corresponding to a desired profile to be generated by the blade with respect to the ground surface.

14. The self-propelled work vehicle of claim 13, wherein the controller is configured to determine the desired profile to be produced by the blade with respect to the ground surface by setting a first target value corresponding to a pitch angle of the chassis relative to the ground and a second target value corresponding to a lift position of the blade relative to the chassis, determine error values corresponding at least to detected differences between the actual pitch angle, the actual lift position, and the respective first and second target values, and automatically control the position of the blade, further as a function of the determined error values.

15. The self-propelled work vehicle of claim 14, wherein the first and second target values are set to correspond with inputs received from a user via a user interface to an automated grade control system.

16. The self-propelled work vehicle of claim 14, wherein the controller is configured to:

selectively enable a first mode of operation, wherein at least a lift position is controlled based on control signals responsive to manual input commands, upon conclusion of the first mode of operation when manual input commands are terminated, to set the first and second target values to correspond with respective detected actual values for the pitch angle of the chassis relative to the ground and the lift position of the blade relative to the chassis, and to initiate a second mode of operation, for automatically controlling the position of the blade as a function of each of the actual pitch velocity of the chassis, the actual pitch angle of the chassis relative to the ground, and the actual lift position of the work implement relative to the chassis, corresponding to the desired profile with respect to the ground surface.

17. The self-propelled work vehicle of claim 14, wherein detected actual values for the pitch angle of the chassis relative to the ground and the lift position of the blade relative to the chassis are provided as inputs to a filtering stage, wherein the first and second target values are dynamically set to correspond with respective outputs from the filtering stage.

18. The self-propelled work vehicle of claim 13, wherein the controller is configured to project one or more virtual sensors upon respective locations associated with the blade, determine a desired profile to be produced by the blade with respect to the ground surface by setting one or more target values corresponding to respective characteristics at each of the one or more location, and generate predicted values for the respective characteristics at each of the one or more locations, as a function of at least each of the actual pitch velocity of the chassis, the actual pitch angle of the chassis relative to the ground, and the actual lift position of the work implement relative to the chassis.

19. The self-propelled work vehicle of claim 18, wherein the controller is configured to:

determine error values corresponding at least to calculated differences between the predicted values and the target values for the respective characteristics, and automatically control the position of the blade, further as a function of the determined error values.

20. The self-propelled work vehicle of claim 13, wherein the positioning unit comprises a lift cylinder, a tilt cylinder, and an angle cylinder for actuating the blade in respective lift, tilt, and angle directions, and wherein at least one of the second set of one or more sensors is coupled to the lift cylinder to generate output signals corresponding to an extension thereof.

* * * * *